US006551562B1

(12) United States Patent
Ahvenniemi et al.

(10) Patent No.: US 6,551,562 B1
(45) Date of Patent: Apr. 22, 2003

(54) METHOD AND APPARATUS FOR GUIDING A WEB OF PAPER OR BOARD WEB DURING MANUFACTURE

(75) Inventors: Vesa Ahvenniemi, Helsinki (FI); Jorma Kinnunen, Helsinki (FI); Seppo Luomi, Järvenpää (FI); Silvo Mikkonen, Vantaa (FI); Vilho Nissinen, Numminen (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/762,825

(22) PCT Filed: Aug. 19, 1999

(86) PCT No.: PCT/FI99/00686

§ 371 (c)(1),
(2), (4) Date: Mar. 30, 2001

(87) PCT Pub. No.: WO00/11266

PCT Pub. Date: Mar. 2, 2000

(30) Foreign Application Priority Data

Aug. 19, 1998 (FI) ..... 981786

(51) Int. Cl.[7] ..... B01J 19/08

(52) U.S. Cl. ..... 422/186.04; 204/164; 226/94

(58) Field of Search ..... 204/164; 226/94; 422/186.04

(56) References Cited

U.S. PATENT DOCUMENTS

| | | | | |
|---|---|---|---|---|
| RE26,951 E | * | 9/1970 | Vaccaro | 204/164 |
| 4,257,167 A | | 3/1981 | Grassman | |
| 4,852,820 A | * | 8/1989 | Looser | 242/56 R |

* cited by examiner

*Primary Examiner*—Kishor Mayekar
(74) *Attorney, Agent, or Firm*—Cohen, Pontani, Lieberman & Pavane

(57) ABSTRACT

Method and apparatus for guiding a web of paper or board or, alternatively, an edge strip sheared therefrom, in a paper machine or finishing equipment, the method being particularly suited for threading the web tail or edge strip through the machine in conjunction with a production shutdown or after a web break. According to the invention, the web (6) or its tail sheared from the web so as to form an edge strip is supported electrically by means of taking surfaces or electrodes (3, 5) disposed on opposite sides of the web (6) to different potentials. Particularly advantageously, the web (6) or the edge strip can be adhered to a roll (16), a belt (7) or a wire by taking said support element to a lower potential and disposing a higher-potential electrode (5) or a number of electrodes to the opposite side of the web.

20 Claims, 3 Drawing Sheets

METHOD AND APPARATUS FOR GUIDING A WEB OF PAPER OR BOARD WEB DURING MANUFACTURE

PRIORITY CLAIM

This is a national stage of PCT application No. PCT/FI99/00686, filed on Aug. 19, 1999. Priority is claimed on that application, and on patent application Ser. No. 981786 filed in Finland on Aug. 19, 1998.

FIELD OF THE INVENTION

The present invention concerns a and apparatus for guiding a web of paper or board or, alternatively, a strip sheared therefrom, in a paper machine or finishing equipment, the method being particularly suited for threading the web tail or edge strip through the machine after a production shutdown or after a web break.

BACKGROUND OF THE INVENTION

After a web break or production shutdown on a papermaking line, the web being processed must be threaded through the machine in conjunction with the next startup. Guidance of the web tail during threading is clumsy and, moreover, is further complicated by the huge width of modern paper machines and the practical constraint that the machine must be accelerated to a relatively high speed before the web tail can be passed through the machine. Consequently, manual guidance of the web is normally impossible, but rather, an automated technique of web tail threading must be used. In off-machine coating lines, manual threading is also feasible, because herein the base paper web is paid off directly from a ready-wound roll to the coating line. The line need not be started prior to web tail threading, but instead the web tail can be threaded so that the web end is first sheared into a tapering tail having its tip made in the center or edge of the web tail, to which tip is adhered by glueing a rope or belt that is threaded first manually for a certain length into the coating line, and finally the web is pulled with the help of the rope/belt through the entire machine. This kind of web tail threading and adherence of the rope to the web tail is a clumsy operation causing notable reduction in productivity due to web breaks.

An alternative method of threading the web through the machine is to use tail threading ropes. The threading rope system comprises a plurality of paired loops of ropes placed on one side of the machine, whereby the nips formed between the rope loops can accomplish tail threading by transporting a narrow leader strip cut to the web tail. In this method, web tail threading takes place by trimming the edge of the leading web tail at the breakage point into a narrow leader strip that is carried downstream along the side of the machine in the nip formed between the opposed ropes. Each pair of the rope loops extends over a given length of the machine and the edge strip is delivered at the downstream end of each rope loop to the next rope loop. When the edge strip is being transported downstream, the rest of the web is directed to the pulper, whereby a substantial amount of broke results. After the edge strip has been delivered by one loop to be transported by the next pair of opposed ropes, the web can be allowed to assume its full width. This takes place by moving the edge-strip-shearing knife in a cross-machine direction over the running web, whereby the web is widened from the narrow edge strip to its full width and, simultaneously, the web widening with the progress of the cutting operation up to its full width is guided in the machine to the next rope nip, where the excess width of the web is directed into the pulper. Subsequently in this manner, the edge strip is passed into the next rope nip, transported therein over the entire length of the rope loop and then again widened to its full width. Naturally, the edge strip can be passed through a number of rope loops prior to moving the cutting knife to widen the web to its full width, but herein the risk of breaking the thin edge strip increases. As such, the break of the edge strip is not catastrophic, but should a break occur, the threading of the edge strip must be restarted downstream along the web travel from a point upstream to the breakage point and, thereby, the time spent for web tail threading is extended.

Instead of using a threading arrangement based on a rope nip, the web can be threaded using a belt threading system in which the edge strip is adhered to the threading belt using glue or self-adhesive tape and then proceeding the threading in the above-described manner.

In modern paper coating equipment, supported web threading is preferred. Herein, it is important to keep the web steady on the support belt or wire. Conventionally, the web is adhered by means of suction rolls or other vacuum devices or, alternatively, using air-blasting during drying for instance, and generally the wet web adheres relatively tenaciously to the belt-like support means. Yet, supported web guidance at the delivery of the web from one support element to another remains problematic and moreover so in the application of a coating wherein the web must always be supported from its dry side requiring that the supported side of the web is changed at each new support element. The web support at the crossover point can be provided by means of a short support belt or using an air-jet supported web travel. Conventionally, air-jet supported web travel is used in a dryer section, whereby the air flow serves for both the drying energy transfer to the web and the support of the web travel.

In the art, there are still problems in the support and guidance of the web tail travelling from one roll to the next and, in a winder, onto the mandrel in conjunction with a roll change.

SUMMARY OF THE INVENTION

It is an object of the present invention to provide a method suited for on-line guidance and support of a running web of paper or board or, alternatively, a threading tail thereof during its travel through a papermaking machine and finishing equipment related thereto.

The goal of the invention is achieved by virtue of supporting the web or, respectively, a threading tail of the web, by electrical means comprising surfaces or electrodes adapted to the opposite sides of the web and brought to different electrical potentials. Particularly advantageously, the web or the leader strip of the web can be adhered to a support roll, belt or wire by bringing said support element to a low potential and placing on the opposite side of the travelling web an electrode or number of electrodes brought to a higher potential.

The invention provides significant benefits.

By virtue of the invention, the edge strip of the web can be passed during tail threading in a reliable manner over the unsupported crossover points of the supported path from one support element to the next support element, e.g., into the next rope nip. When so required, the rope nips can be replaced by belts, whereby the arrangement according to the invention provides electrical adherence of the edge strip to the belt thus enabling only one belt to be used for carrying the edge strip forward. If the web is arranged to travel supported over almost its entire length, a separate threading rope or belt system is not necessarily needed, because the edge strip may be adhered to the support element and, by electrical means, passed over the discontinuities of the web path. In fact, the web may be even guidedly passed at web path crossover points, e.g., from a belt onto a roll and vice versa by virtue of making it supportedly float under the guidance of electric forces. In fast machines the invention can be applied for eliminating web bagginess, which is caused by air entrainment at backing rolls supporting a fast running web, by means of bringing the backing roll to a low potential and then placing electrodes of higher potential to the opposite side of the web. This arrangement causes the web to adhere firmly to the backing roll, whereby air cannot readily become entrained between the web and the roll. With the help of the electric field, the web can also be released from the roll and transported to the next roll or belt/wire in the same fashion as has to date been done using an air jet and a releasing doctor blade. Web threading implemented using rope carriers has a problem in that carrier ropes cannot be passed via coaters and web measurement beam devices, but instead, the ropes must make a bypass at these units. Now the novel invention makes it possible to pass the edge strip of the web electrically supported in the gaps of these units, thus permitting the carrier ropes or belts to have a discontinuity at these points. By virtue of the invention, two-sided measurement of the web can be accomplished also along a supported web travel in as much the web support at the gauging equipment can be implemented using electrical means instead of a wire or belt.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be ma de to the appended claims.

In the following, the invention is described in more detail with reference to appended drawings in which like reference numerals delineate similar elements throughout the several views.

DETAILED DESCRIPTION OF THE PRESENTLY PREFERRED EMBODIMENTS

Figure 1:
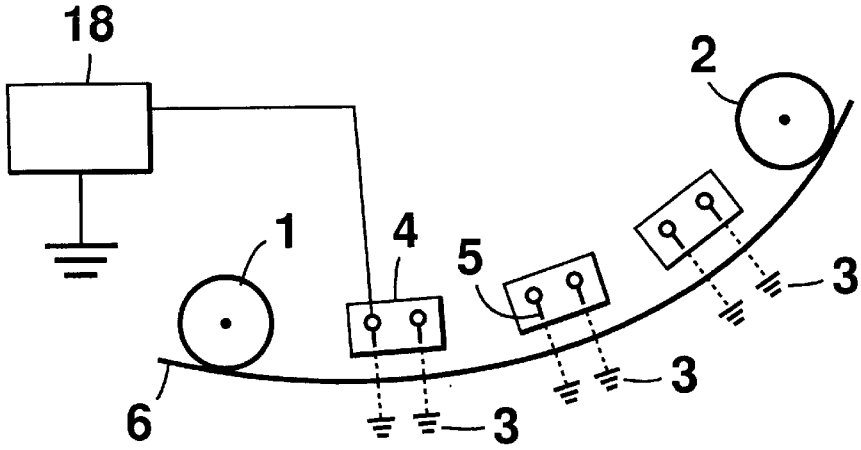
FIG. 1 shows diagrammatically a web guidance system according to the invention adapted at the crossover point between two rolls.

Using an arrangement according to the invention, electric forces can be used for adhering a web or an edge strip thereof to a moving carrier such as a wire, belt, band or for guiding around a roll. Herein, it is often sufficient to pass the web past the gap of two electrodes over which a potential difference is applied. Then, a web passing through the electrode gap is transferred under electric forces to the electrode of the lower potential and is adhered thereto. Web guidance may, however, be implemented more advantageously using the so-called ion-blast technique particularly in cases where the web is desired to be guided by means of the method according to the invention along a curved path.

The ion-blast technique, or "ionipuhallustekniikka", is based on forming a strong electric field between one or typically a plurality of pointed electrodes and one planar counterelectrode. The tip of the pointed electrode emits a corona discharge that charges particles located in the vicinity of the electrode tip thus causing the generation of ions in the electronegative gaseous medium. The ions migrate along the field lines extending between the electrode and the counterelectrode which is taken to the ground potential or even to a lower potential, whereby the ions adhere to particles they meet on their travel. The electric field transports the charged particles over the interelectrode gap toward the ground-potential electrode, where they attach to the substrate by electric and mechanical forces. If the distance between the opposed electrodes is large and the applied voltage is high (more than 50 kV); a gas flow is established between the opposed electrodes that mechanically transports the charged particles within the interelectrode gap toward the ground potential. This flow is conventionally known as ion blast. In the ion-blast phenomenon, the electric field exiting from the tip of the pointed electrode forms a conical field pattern in which the ionized gas and charged particles move.

The effective coverage of the conical flux tubes emitted by the electrode tips must extend over the desired area on the web. As the electric field lines leaving the tip of each pointed electrode form a flux tube of a conical shape, the number and location of electrode tips must be configured so that the conical flux tubes leaving the staggered electrode tips provide a field pattern of uniform coverage on the counterelectrode. The voltage applied to the electrodes is dependent on the distance between the counterelectrode and the electrode tips that may be varied from 2 mm to 2 m; however, to keep the space requirements of the different devices comprised in the equipment within practicable limits, an interelectrode distance range of 100–1000 mm is favored. While a large interelectrode distance as such does not impair the function of the apparatus, it increases the external dimensions of the system. When using a design based on the practicably most favorable interelectrode distance range, the voltage applied between the opposed electrodes is typically set to be in the range 80–160 kV, but may be varied as widely as from 30 kV to 1000 kV. The counterelectrode may be run positive or negative, and the electrode tips may respectively be connected to the negative or positive terminal of the power supply.

In FIG. 1 is shown the control of web travel by means of ion-blast devices along a curved path downstream from a first roll 1 to a second roll 2. This arrangement is suited for, e.g., guiding the web from a coating station backing roll 1 in a noncontacting manner along a curved path to a first lead-in roll 2 of the dryer section. In the embodiment illustrated in FIG. 1, the counterelectrodes 3 that form the lower-potential electrodes 3, advantageously connected to the ground potential, are disposed on the outer perimeter side of the curved web path, while the pointed electrodes 5 placed in enclosures 4 are disposed on the inner perimeter side of the curved web path. Then, the ion blast emitted by the pointed electrodes 5 moves the web 6 by electric forces and the mechanical effects of the ion-blast gas flow toward the ground electrodes 3, whereby the web 6 is tensioned on a curved path determined by the arrangement of the electrodes 3, 5. In the same fashion the web may also be transported along a straight path if the electrodes of the higher and lower potential are disposed in an alternating manner to opposite sides of the web. While not explicitly mentioned, the electrodes are in a conventional manner fed by a high-voltage power supply 18, as is also the case in the alternative embodiments described later in the text. The polarity of the electrodes is made changeable, e.g., by providing the power supply with appropriate switch-over means. Then, the polarity change can be implemented by manual means or, alternatively, utilized for automated control of web travel.

Figure 2:
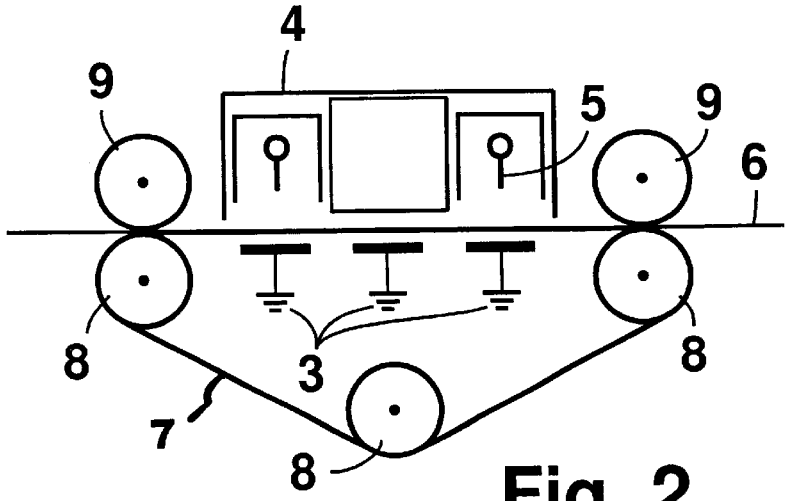
FIG. 2 shows diagrammatically a direct web guidance arrangement between two rolls.

In FIG. 2 is shown the adherence of the web to a support belt 7. The support belt is arranged to travel about a set of guide rolls 8 disposed in a triangular configuration in which two of the guide rolls 8 are placed in a close proximity of web guide rolls 9 so that the web 6 travels supported by said belt between said latter rolls. Over the travel of the web 6 supported by the belt 7, there are disposed three counter-electrodes 3 and three separate groups of ion-blast electrodes are located thereabove on the opposite side of the web. The web support belt is advantageously made from a conducting material. In the illustrated embodiment, the web 6 is adhered by electric forces to the belt 7 and, supported by the said belt, travels the distance between the guide rolls 9 supporting the web 6. Alternatively, the same assembly may be used for guiding and supporting an edge strip or a full-width web between two support elements such as a belt or wire or for supporting an edge strip over the distance between two rope nips. The assembly is advantageously made movable, thus allowing the assembly to be introduced to the crossover point of the support system at the start of tail threading and then to be retracted after a successful web threading operation.

Figure 3:
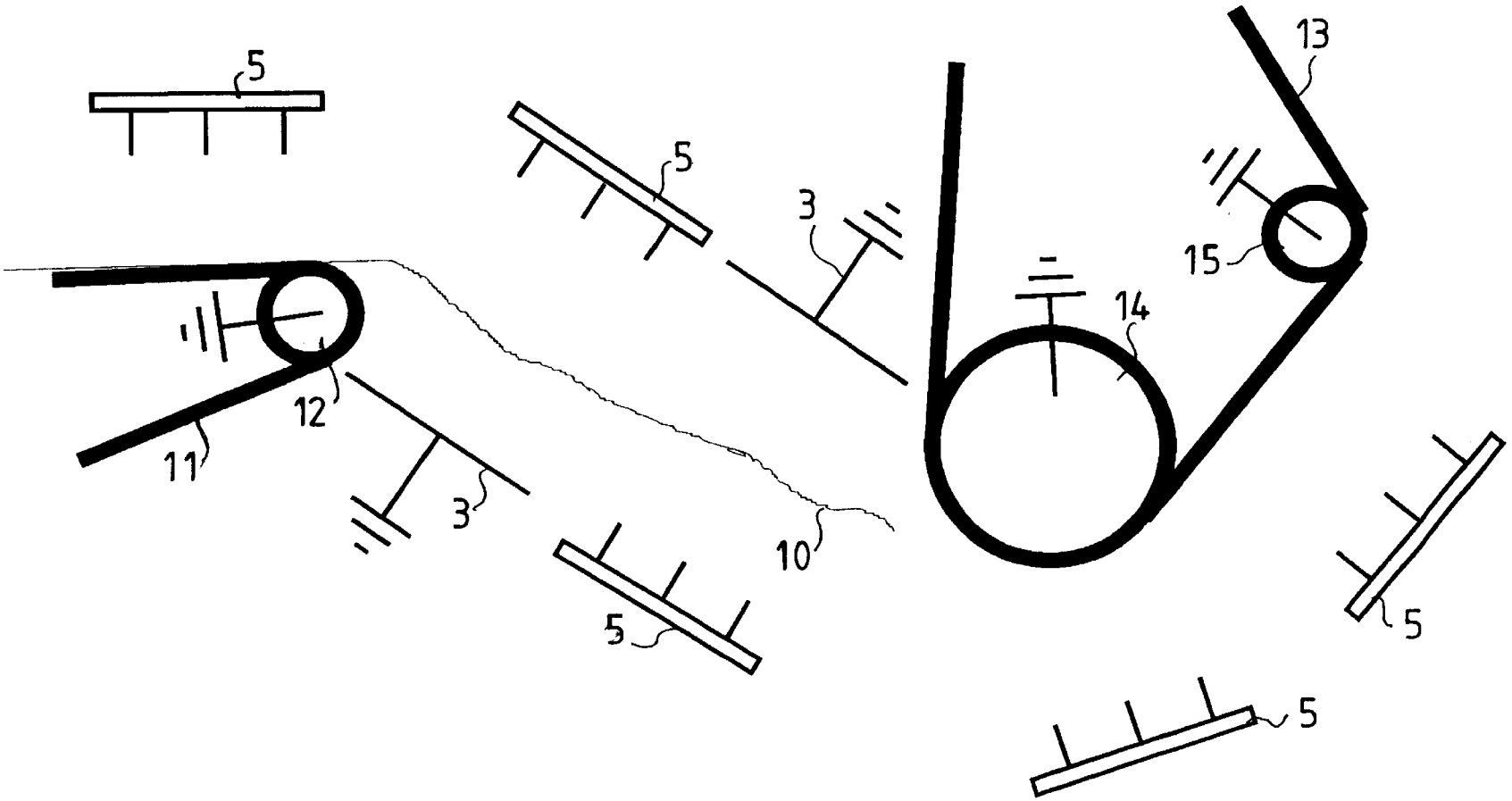
FIG. 3 shows an edge strip guidance arrangement according to the invention between two rope loops.

In FIG. 3 is shown an arrangement according to the invention for guiding the edge strip at the crossover point between two support belts. Also an arrangement may be contemplated capable of guiding a full-width web at the cross-over point of two support belts or wires. As shown in the diagram, the edge strip 10 leaves a first guide belt 11 to be next passed via the gap formed between electrodes 5 and 3 of a deflection roll onto another guide belt 13 arranged to pass over rolls 14, 15. From the first belt 10, the edge strip is guided by means of the electrodes 3, 5 to a roll 14 from which the edge strip 10 is deflected by means of a second set of electrodes 5 toward the guide belt 13 passing over the guide roll 14. In the illustrated embodiment, the edge strip 10 is transported by being adhered to the guide belts 11 and 13 with the help of electrical field techniques. The first guide belt 11 passes over at least one guide roll 12 taken to a lower potential, thereby also taking the guide belt 11 to said lower potential. To the side of the guide belt 11 facing the edge strip 10, there is disposed a higher-potential electrode 5 that in cooperation with the conducting guide belt 11 forms an electric field capable of adhering the edge strip to the guide belt 11. The edge strip 10 is adhered in a similar manner with the help of the field emitted by the guide electrodes 5 to the next guide belt which is taken to the ground potential via guide rolls 14, 15. Over the web travel portion remaining between the belts 11, 13, the edge strip 10 is transported with the help of the electric field formed between the fixed electrodes 3, 5. These electrodes are arranged so that to opposite sides of the travelling edge strip are disposed electrodes taken in an alternating order to a lower and a higher potential, thus causing the direction of the electric field to change cyclically so that the edge strip stays centered between the electrodes. In this fashion, the edge strip can be passed through the entire machine adheringly supported by the guide belts.

Figure 4:
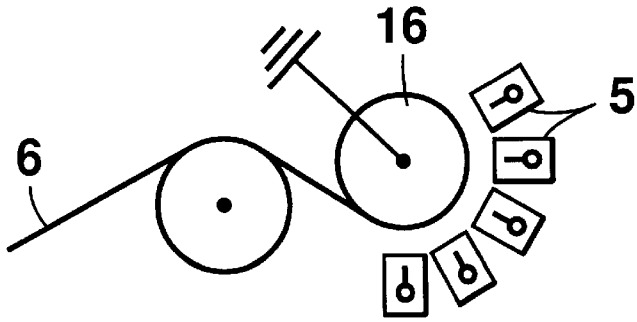
FIG. 4 shows a guidance arrangement according to the invention for engaging the web tail around a winder mandrel.

In FIG. 4 is shown one technique of guiding the web tail around a winder mandrel 17. In the illustrated embodiment, the mandrel 17 is brought to the lower potential, advantageously to the ground potential, and the electrodes taken to the higher potential are arranged in groups surrounding the mandrel 16. Since this arrangement functions very satisfactorily based on the electrostatic field alone, the shape of the electrodes can be varied freely. As ion-blast forces, however, offer a more effective technique of moving the tail of the web 6 toward the mandrel 16, the use of pointed electrodes combined with a high potential difference is more advantageous. Obviously, while the assembly of FIG. 4 can be used for guiding a web tail to rolls or cylinders, it requires additional means such as a mechanical scraper for preventing the winding-up of the web tail about the roll/cylinder and for urging the tail to travel forward in the machine.

Figure 5:
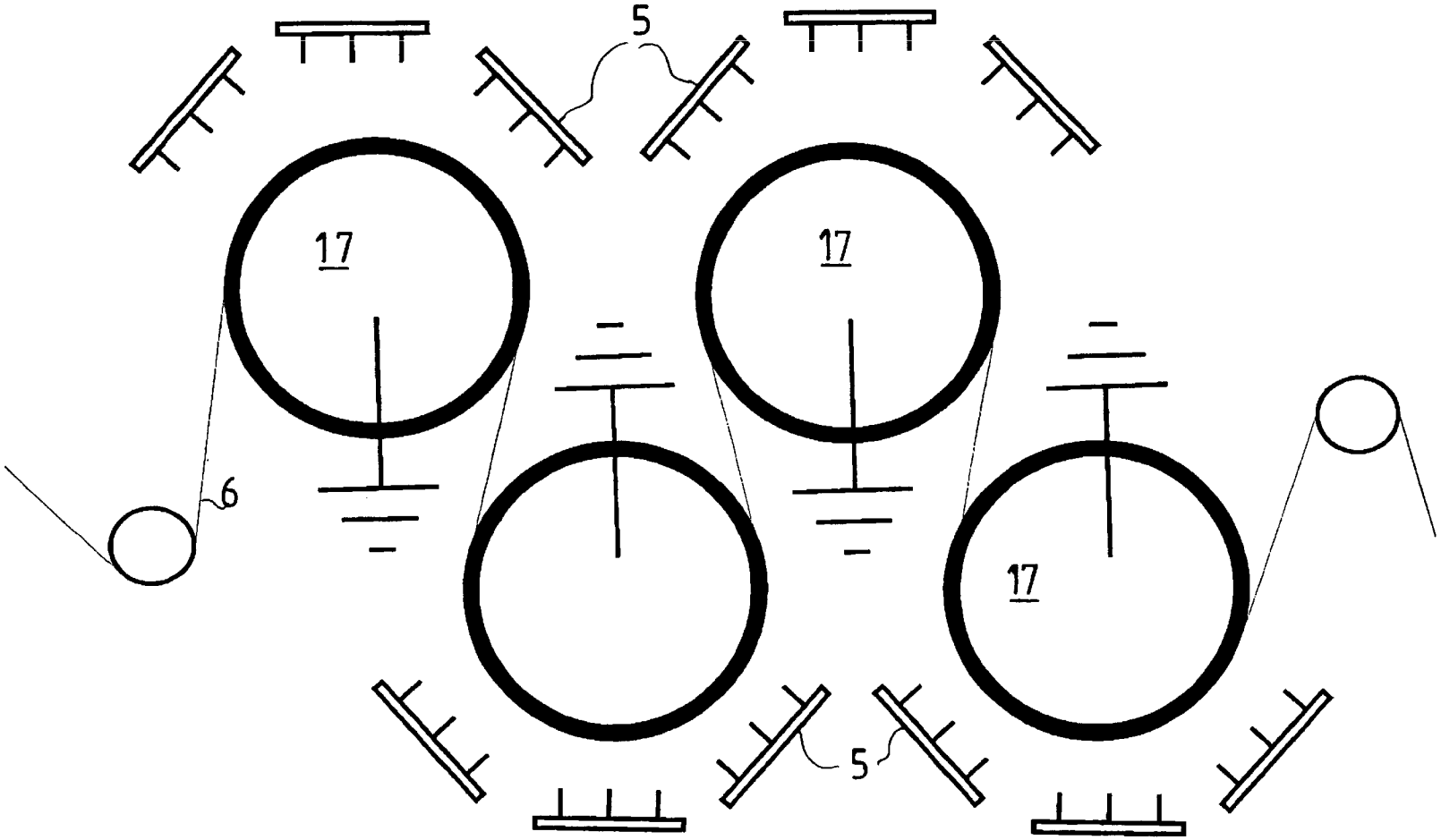
FIG. 5 shows a draw roll group in which the web is adhered to the rolls by electrical means.

In FIG. 5 is shown an assembly capable of improving the adherence traction imposed by the drawing cylinder group on the web. At high web speeds, the air travelling as a boundary layer on the web surface becomes entrained into the converging nip between the rolls 17 and the web 16, whereby the traction of the nip on the web is lost. Then, the draw that tensions the web cannot be maintained and the transport of the web through the machine becomes complicated. The traction can be improved by taking the draw rolls 17 to a low potential, advantageously to the ground potential, and simultaneously arranging to a close proximity thereof a set of higher-potential electrodes 5, whereby the electric field established between the rolls and the electrodes adheres the web to the draw rolls without any loss of traction. The electric field also increases the mechanical friction by preventing the entry of air into the nip between the rolls and the web. Besides in draw roll groups, the arrangement of FIG. 5 may also be used in conjunction with other rolls such as dryer cylinders not equipped with a support wire.

In addition to those described above, the invention may have alternative embodiments.

In coater stations, for instance, the invention may be utilized for preventing bagginess of the web. Bagginess results from the entrapment of air travelling along with the web into the converging nip between a roll and the web passing over the same, thus separating the web from the roll, whereby a bag is formed in the web in front of a coating applicator or the doctor units when the web is pressed against the backing roll. Bagginess can be avoided by taking the backing roll to the ground potential or a low potential and disposing at the tangential meeting point of the web with the backing roll an electrode which is taken to a higher potential, whereby the web adheres under the electric forces to the roll and, simultaneously, the entry of air into the nip between the roll and the web is prevented.

The ion-blast apparatus may under some conditions act as a capacitor that accumulates an electric charge, whereby the forces adhering the web to the conducting support element become unwieldy after the web has exited from under the counterelectrode. To eliminate the effect of such adhering forces, a positive- or negative-potential corona discharge treatment can be applied downstream from the electrodes. The required corona treatment is applied using a device similar to the above-described ion-blast assembly. Instead of having a pointed tip, the electrodes may be shaped as planar or rail electrodes, and respectively, the counter-electrode need not necessarily be taken to the ground potential with the provision that its potential must obviously be lower than that of the corona-discharge-emitting electrodes or other high-potential electrodes.

Thus, while there have been shown and described and pointed out fundamental novel features of the present invention as applied to preferred embodiments thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for guiding a moving web of paper or board in at least one of a paper machine and paper finishing equipment in which the web is guided by guiding elements, comprising:

positioning a primary electrode at a position being one of proximate to and in contact with a first surface of the web;

positioning a secondary electrode at a position being one of proximate to or in contact with a second surface of the web; and generating an electric potential between the primary electrode and the secondary electrode to form an electric field between said electrodes sufficient to attract the web toward one of the electrodes, wherein the primary and secondary electrodes are positioned to guide the web through a gap between a first web guide element and a second web guide element, at least one of the first guide clement and the second web guide element comprising an endless belt.

2. The method of claim 1, wherein the electric potential of the primary electrode is lower that the electric potential of the secondary electrode, and wherein the web is attracted toward the primary electrode.

3. The method of claim 2, wherein the primary electrode comprises a mandrel used in winding the web into a roll, and wherein the web is guided by the electrodes to wind on the mandrel.

4. The method of claim 1, wherein the primary electrode is comprised of an endless moving loop of electric field conducting material, and wherein at least a portion of the first surface of the web is in contact with at least a portion of the endless loop.

5. The method of claim 4, wherein the electric potential of the endless loop of the primary electrode is lower that the electric potential of the secondary electrode, and wherein at least a portion of the first surface of the web adheres to at least a portion of the endless loop of the primary electrode.

6. The method of claim 4, wherein the web comprises one of a web tail and a web edge strip.

7. The method of claim 1, wherein the electric potential between the primary electrode and the secondary electrode is such that a corona discharge is established between the electrodes capable of causing an ion blast to be directed toward one of the electrodes, the ion blast being sufficient to urge the web in a direction of the ion blast.

8. The method of claim 7, wherein the web comprises one of a web tail and a web edge strip.

9. The method of claim 1, wherein at least one of the electrodes is stationary.

10. The method of claim 9, wherein the web comprises one of a web tail and a web edge strip.

11. The method of claim 1, wherein the web comprises one of a web tail and a web edge strip.

12. The method of claim 1, wherein the primary electrode comprises a mandrel used in winding the web into a roll, and wherein the web is guided by the electrodes to wind on the mandrel.

13. A method for guiding a moving web of paper or board in at least one of a paper machine and paper finishing equipment in which the web is guided by guiding elements, comprising:

positioning a primary electrode at a position being one of proximate to and in contact with a first surface of the web;

positioning a secondary electrode at a position being one of proximate to or in contact with a second surface of the web; and generating an electric potential between the primary electrode and the secondary electrode to form an electric field between said electrodes sufficient to attract the web toward one of the electrodes, wherein a polarity of the primary electrode and the secondary electrode is altered to change a direction of the electric field generated between the electrodes.

14. An apparatus for on-line guidance a moving web of paper or board in at least one of a paper machine and paper finishing equipment in which the web is guided by guiding elements, comprising:

a primary electrode at a position being one of proximate to and in contact with a first surface of the web;

a secondary electrode at a position being one of proximate to or in contact with a second surface of the web; and a means electrically connected to said primary electrode and said secondary electrode for generating an electric potential between said primary electrode and said secondary electrode to form an electric field between said electrodes sufficient to attract the web passing between said electrodes toward one of said electrodes, wherein the primary and secondary electrodes are positioned to guide the web through a gap between a first web guide element and a second web guide element, and wherein at least one of said first guide element and said second guide element comprises an endless belt.

15. The apparatus of claim 14, wherein the primary electrode is comprised of an endless moving loop of electric field conducting material positioned substantially along a path of travel of the web, and wherein said electric potential generating means is capable of generating an electric field between said electrodes to cause at least a portion of the first surface of the web to contact at least a portion of the endless loop.

16. The apparatus of claim 14, wherein at least one of the electrodes is stationary.

17. The apparatus of claim 14, wherein the primary electrode comprises a mandrel used in winding the web into a roll, and wherein the web is guided by the electrodes to wind on the mandrel.

18. The apparatus of claim 14, wherein the primary electrode comprises a roll, and wherein the web is guided by the electrodes to adhere to and partially wrap around the roll.

19. The apparatus of claim 14, wherein at least one of said primary electrode and said secondary electrode is capable of being movable substantially away from the web while said electrodes are not in use.

20. The apparatus of claim 19, wherein the primary electrode is comprised of an endless moving loop of electric field conducting material positioned substantially along a path of travel of the web, and wherein said electric potential generating means is capable of generating an electric field between said electrodes to cause at least a portion of the first surface of the web to contact at least a portion of the endless loop.

* * * * *